US005630473A

United States Patent [19]

Nishishita

[11] Patent Number: 5,630,473

[45] Date of Patent: May 20, 1997

[54] LAMINATED HEAT EXCHANGER

[75] Inventor: Kunihiko Nishishita, Konan, Japan

[73] Assignee: Zexel Corporation, Tokyo, Japan

[21] Appl. No.: 611,671

[22] Filed: Mar. 6, 1996

Related U.S. Application Data

[62] Division of Ser. No. 550,290, Oct. 30, 1995.

[30] Foreign Application Priority Data

Nov. 4, 1994 [JP] Japan ..... 6-295862

[51] Int. Cl.[6] ..... F28D 1/03

[52] U.S. Cl. ..... 165/153; 165/176

[58] Field of Search ..... 165/153, 176, 165/167; 62/515

[56] References Cited

U.S. PATENT DOCUMENTS 3,976,128 8/1976 Patel et al. ..... 165/153
5,062,477 11/1991 Kadle ..... 165/176 X

FOREIGN PATENT DOCUMENTS 171591 7/1990 Japan ..... 165/153
94328 4/1994 Japan ..... 165/153

*Primary Examiner*—Leonard R. Leo
*Attorney, Agent, or Firm*—Wenderoth, Lind & Ponack

[57] ABSTRACT

In a laminated heat exchanger constituted by laminating tube elements. Each tube element is constituted by bonding two formed plates together to form a U-shaped flow passage interconnecting a pair of tank portions at one end. A plurality of shoal-like beads are formed in an area extending from the tank portions to the U-shaped passage portion. The bonding width of the shoal-like bead formed in the central area is greater than the bonding widths of the shoal-like beads formed on opposite sides. This improves the bonding strength in the central area where the tank portions change into the U-shaped passage portion to prevent rupture caused by high pressure fluid in the area. The strength of the area that is most likely to rupture in the area where the tank portions change into the U-shaped passage portion is increased.

5 Claims, 8 Drawing Sheets

LAMINATED HEAT EXCHANGER

This is a Rule 60 Divisional application of parent application Ser. No. 08/550,290 filed Oct. 30, 1995.

BACKGROUND OF THE INVENTION

1. Field of the Invention

The present invention relates to a laminated heat exchanger constituted by laminating tube elements and fins alternately over a plurality of levels and used for a cooling cycle and the like in air conditioning systems for vehicles. In particular, the present invention relates to a laminated heat exchanger that employs a structure in which a pair of tank portions are formed at one side of each tube element.

2. Description of the Related Art

In a laminated heat exchanger of this type, as disclosed in Japanese Unexamined Patent Publication No. H4-32697, tube elements are laminated alternately with fins over a plurality of levels. A pair of tank portions are formed at one end of each tube element with the pair of tank portions communicating with each other through a U-shaped passage portion. Adjacent tube elements communicate as necessary through the bonding of their tank portions, a plurality (three, for instance) of shoal-like beads are formed in the area of each tube element where the tank portions change into the U-shaped passage portion and the shoal-like beads that face opposite are flush to each other and bonded.

However, when a rupture test is performed on a laminated heat exchanger structured as described above by pumping high pressure fluid (at 30–40kg/mm$^2$) into the tank portions, the bond between the shoal-like beads is broken in the tube elements located near the two ends in the direction of lamination. It has become clear that, as a specific phenomenon among the shoal-like beads, the rupture occurs starting with the bead at the central area (bead **26*b* in the example shown in FIG. 4**). This is due to larger deformation occurring in the central area than at the ends of the tank portions as the number of laminated tube elements increases.

Such a rupture test conducted on a heat exchanger in which a special communicating passage, extending in the direction of lamination, is provided between the tank portions to induce the heat exchanging medium to specific tank portions via the communicating passage (a heat exchanger such as that shown in FIG. 9), has shown that the rupture occurs starting with the shoal-like bead **36*c*** located near the connecting portion where the communicating passage is connected. The cause of the rupture is that the tank wall portion that faces opposite the connecting portion of the communicating passage becomes distended by the pressure of the fluid coming through the communicating passage, as indicated with the broken line, making the quantity of deformation larger than in the other areas of the tank portion.

SUMMARY OF THE INVENTION

Accordingly, the object of the present invention is to increase the strength of the portion that is more readily ruptured in the U-shaped passage portion, particularly in the area where the tank portion changes into the U-shaped passage portion, in a laminated heat exchanger provided with a pair of tank portions at one side of each tube element.

In heat exchangers of the prior art, the bonding margin of the shoal-like beads is consistent regardless of the location, which resulting in an area that is relatively susceptible to deformation. Therefore the inventor of the present invention realized that by increasing the bonding margin of the shoal-like beads in the area where a rupture is likely to occur, the strength of that portion is improved.

Accordingly, the laminated heat exchanger according to the present invention is constituted by laminating tube elements, each of which is provided with a pair of tank portions at one side and a U-shaped passage portion communicating between the pair of tank portions and fins alternately over a plurality of levels. Adjacent tube elements are made to communicate as necessary by connecting through the tank portions, a plurality of shoal-like beads are flush to each other in the area where the U-shaped passage portion changes to the tank portion and bonded. The bonding margin of the shoal-like beads that are formed in the central area of the U-shaped passage portion is made larger than the bonding margin of other shoal-like beads (first mode).

Another structural example of the laminated heat exchanger according to the present invention is constituted by laminating tube elements, each of which is provided with a pair of tank portions at one side and a U-shaped passage portion communicating between the pair of tank portions, and fins alternately over a plurality of levels, with tube elements communicating with adjacent tube elements as necessary by connecting through the tank portions so that heat exchanging medium flows into specific tank portions via the communicating passage extending in the direction of lamination. A plurality of shoal-like beads are flush to each other in the area where the U-shaped passage portion changes into the tank portion and bonded. The bonding margin of the shoal-like beads in the specific tank portion located near the communicating passage, is made larger than the bonding margin of other shoal-like beads (second mode).

Consequently, since the bonding margin for the shoal-like bead located in the area where the tank portions changes into the U-shaped passage portion and where deformation tends to occur is formed large, the bond is stronger in this area, making rupture less likely to occur.

According to the present invention pertaining to claim 1, the shoal-like bead is strongly bonded in the central area of the U-shaped passage portion where the tank portion changes into the U-shaped passage portion and, according to the present invention pertaining to claim 2, among the shoal-like beads in the tank portion, the bead that is close to the connecting portion where the communicating passage is connected is strongly bonded, improving the strength in these areas in a similar manner, and achieving the object described earlier.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of the embodiments according to the present invention in reference to the drawings.

Figure 1A:
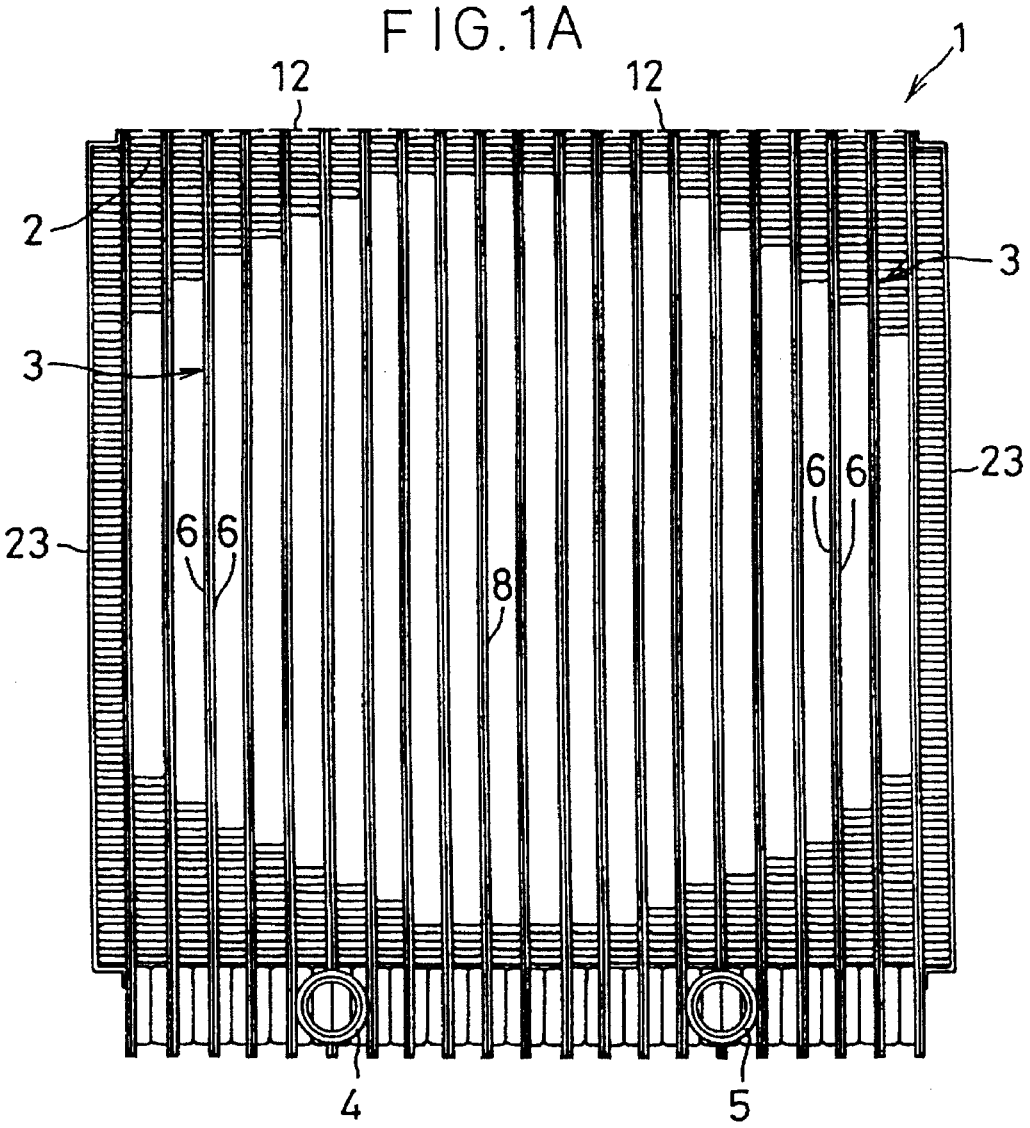
FIGS. 1A and 1B illustrate an embodiment of a laminated heat exchanger according to the present invention, with FIG. 1A showing a front view and FIG. 1B showing a bottom view.
Figure 1B:
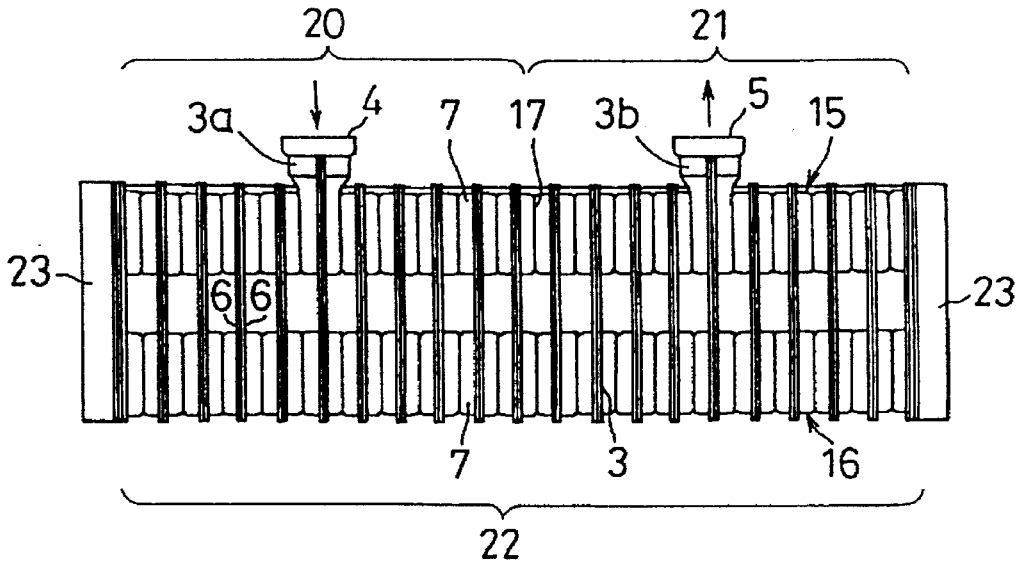

In FIGS. 1A and 1B, a laminated heat exchanger 1 may be, for instance, a four-pass type evaporator constituted by laminating fins 2 and tube elements 3 alternately over a plurality of levels, with an intake portion 4 and an outlet portion 5 for heat exchanging medium provided in the middle area of the lamination. Most of the tube elements 3 are formed by bonding two formed plates 6 at their edges. The tube element 3 include a pair of tank portions 7 and a U-shaped passage portion 8 for allowing heat exchanging medium to flow from one tank portion 7 to the other.

Figure 2:
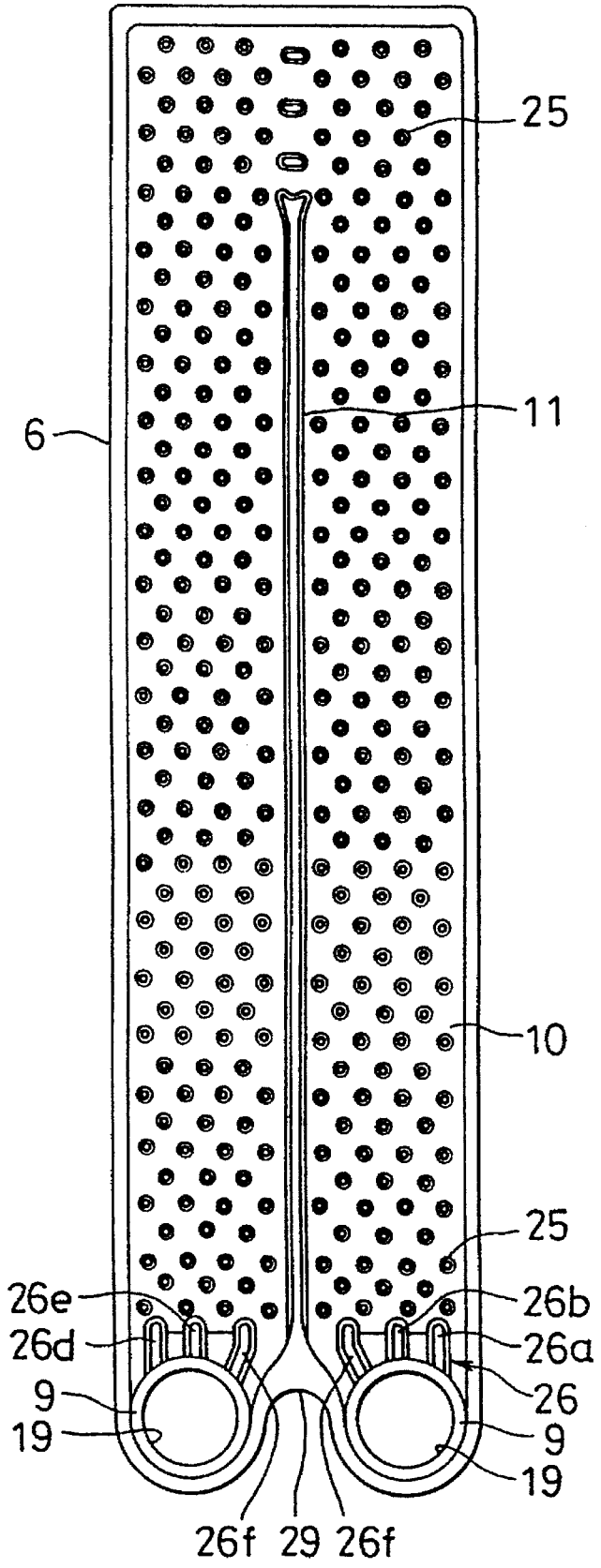
FIG. 2 is a front view of a formed plate used to constitute tube elements used in the laminated heat exchanger shown in FIG. 1.

Each formed plate 6 is formed by press machining an aluminum plate and, as shown in FIG. 2, is provided with two concave distended portions 9 formed at one end and a distended portion 10 for passage formation formed continuously with a projection 11 extending from area between the two distended portions for tank formation 9 to the vicinity of the other end of the formed plate 6. In addition, at the other end of the formed plate 6, a protruding tab 12 (shown in FIG. 1A) is provided for preventing the fins 2 from coming out during assembly and prior to brazing.

The distended portions for tank formation 9 are formed deeper than the distended portion for passage formation 10. The projection 11 is formed so as to be on the same plane as the bonding margin at the edges of the formed plate. Thus, when two formed plates 6 are bonded at the edges, their projections 11 are also bonded and a pair of tank portions 7 are formed by the distended portions for tank formation 9 that face opposite each other. Also, a U-shaped passage portion 8, which connects the tank portions, is formed with the distended portions 10 for passage formation that face opposite each other.

Figure 3:
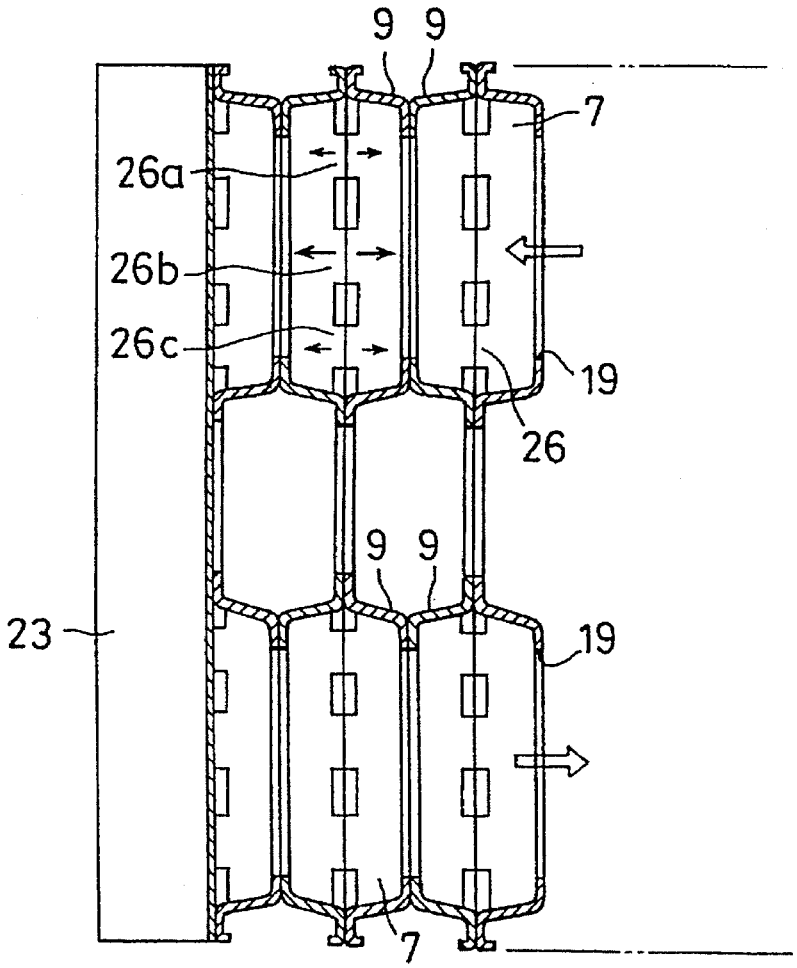
FIG. 3 is a partial, enlarged cross section of the laminated heat exchanger shown in FIG. 1B with some of the tank portions cut away.

In the heat exchanger, adjacent tube elements 3 are flush with one another at the distended portions for tank formation 9 of the formed plates 6 as shown in FIGS. 1 and 3 to form two tank groups, i.e., a first tank group 15 and a second tank group 16, which extend in the direction of lamination (in a direction running at a right angle to the direction of airflow). In one of the tank groups, i.e., the tank group 15, the adjacent tank portions 7 are in communication via communicating holes 19, except at a partitioning portion 17 located at approximately the center in the direction of lamination. In the other tank group, i.e., the tank group 16, all the tank portions are in communication via the communicating holes 19 with no partitioning.

Consequently, the first tank group 15 is divided into two areas, i.e., a first communicating area 20, which includes the intake portion 4, and a second communicating area 21, which includes the outlet portion 5. The areas 20,21 are formed with the partitioning portion 17 as the border, whereas, the second tank group 16, without partitioning, constitutes a third communicating area 22.

Note that the intake portion 4 is formed by projecting out and opening the tank portion of a tube element 3*a* located at approximately the center of the first communicating area 20, in the direction of the airflow. Similarly the outlet portion 5 is formed by projecting out and opening the tank portion of a tube element 3*b*, located at approximately the center of the second communicating area 21 in the direction of the airflow. Also, at the two ends in the direction of lamination of the tube elements, end plates 23 are provided.

Figure 4:
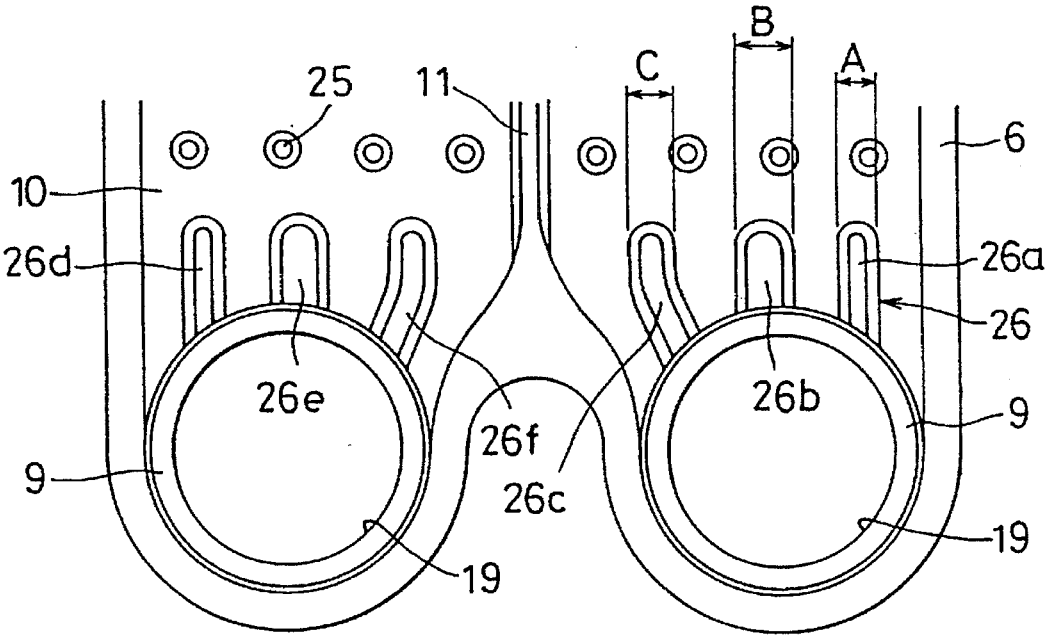
FIG. 4 is an enlarge view of the formed plate shown in FIG. 2, showing its distended portions for tank formation and part of the distended portions for passage formation.

In FIGS. 2 and 4, a number of beads 25, i.e., circular beads 25 for instance, are formed at the time of press machining in order to improve the heat exchange efficiency and each of the beads 25 is made to bond with the bead formed at the corresponding position opposite when two formed plate 6 and 6 are bonded.

A plurality of shoal-like beads 26 (26*a*–26*f*) are formed in the area of the distended portion 10 for passage formation where the distended portions 9 for tank formation change into the distended portion 10 for passage formation, i.e., the area where the tank portion 7 becomes the U-shaped passage portion 8. In this embodiment, three of the shoal-like beads 26*a*–26*f* are formed in the area where each distended portion 9 for tank formation changes into the distended portion 10 for passage formation, and since they are formed symmetrically from the center, the explanation is given only for the side where the heat exchanging medium flows into the U-shaped passage portion 8 from the tank portion 7 (the side where the shoal-like beads 26*a*–26*c* are provided). The shoal-like beads 26*a* and 26*b* are formed linearly in the direction in which the U-shaped passage portion extends, while the shoal-like bead 26c is formed with an angle that points toward the center of the tube element 3.

In addition, among the three shoal-like beads 26*a*–26*c*, the shoal-like bead 26*b* at the center is formed wider than the shoal-like beads 26*a* and 26*c* at its sides. In other words, when the width of the shoal-like bead 26*a* is A, the width of the shoal-like bead 26*b* is B and the width of the shoal-like bead 26*c* is C, their relationship satisfies B>A and B>C. The reason for setting the width of the shoal-like bead 26*b* larger, is that the results of rupture tests indicate that the strength in the central area is relatively less than in the other areas. While one might consider setting the width of all the shoal-like beads larger, in order to gain strength, it is desirable to improve the bonding strength only in the central area where rupture is most likely to occur, as in the present invention, since it is necessary, considering passage resistance, to ensure a certain minimum coolant passage area. As a specific example, we recommend setting B at approximately 4.5 mm with A=C at approximately 3.5 mm, or setting B at approximately 4.3 mm with A=C at approximately 3.2 mm.

Thus, the heat exchanging medium that has flowed in through the intake portion 4 is dispersed throughout the tank portions that constitute the first communicating area 20 and then travels upward through the U-shaped passage portions 8 of the tube elements corresponding to the first communicating area 20 along the projections 11 (first pass). Then it makes a U-turn above the projections, 11 before travelling downward (second pass) to reach the tank group on the opposite side (third communicating area 22). Next, it moves horizontally through the rest of the tube elements 3 which constitute the third communicating area 22, and travels upward through the U-shaped passage portions 8 of these tube elements 3 along the projections 11 (third pass). Then it makes a U-turn above the projections 11 before travelling downward (fourth pass), and is induced to the tank portions that constitute the second communicating area 21. Following this, the heat exchanging medium flows out through the outlet portion 5. This allows the heat of the heat exchanging medium to be communicated to the fins 2 during the process in which the heat exchanging medium flows through the U-shaped passage portions 8 constituting the first through fourth passes, so that heat exchange with the air passing through the fins can be performed.

During this process, since the heat exchanging medium, which flows from the tank portions 7 into the U-shaped passage portions 8 reaches the U-shaped passage portions 8, by travelling from the tank portions 7 with a large passage cross section through the areas between the shoal-like beads with a small passage cross section, a force is imparted in a direction that would separate the bonded shoal-like beads 27*a*, 27*b* and 27*c*, as indicated with the solid-line arrows in FIG. 3. This force is greater on the shoal-like bead at the center than it is on the shoal-like beads at the ends or slides. However, since the bonding margin (brazing margin) of the shoal-like bead at the center is formed larger than those of the shoal-like beads at the ends, a secure bonding state is achieved, making deformation less likely to occur even when high pressure fluid is flowing. In the examples with the suggested specific numerical values, the strength improves by 1–2% in rupture tests.

Figure 5:
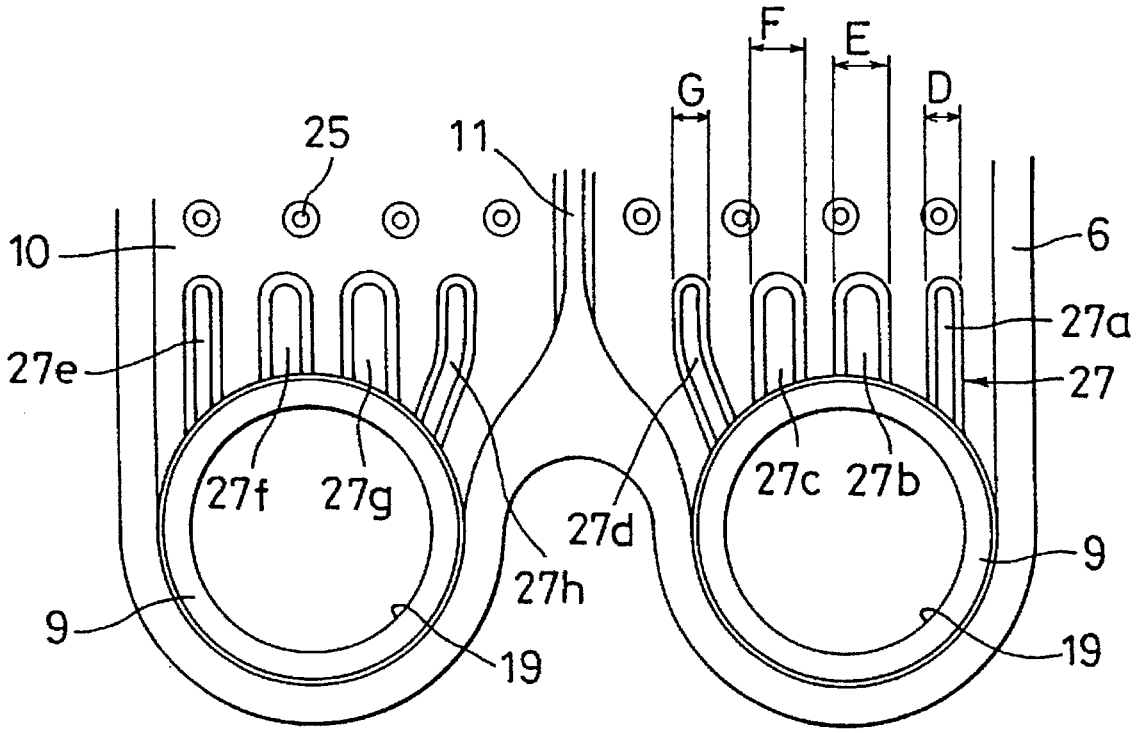
FIG. 5 is an enlarged view of a formed plate showing another embodiment of the distended portions for tank formation and part of the distended portions for passage formation.

Note that there may be more than one shoal-like bead at the center. For instance, if four shoal-like beads 27 are to be provided as shown in FIG. 5, the width of the two middle shoal-like beads 27*b* and 27*c*(27*f* and 27*g*) is larger than that of the shoal-like beads 27*a* and 27*d*(27*e* and 27*h*) at the sides. In other words, when the width of the shoal-like bead 27*a* is D, the width of the shoal-like bead 27*b* is E, the width of the shoal-like bead 27*c* is F, and when the width of the shoal-like bead 27*d* is G, their relationship must satisfy; $D<E\approx F>G$.

Figure 6A:
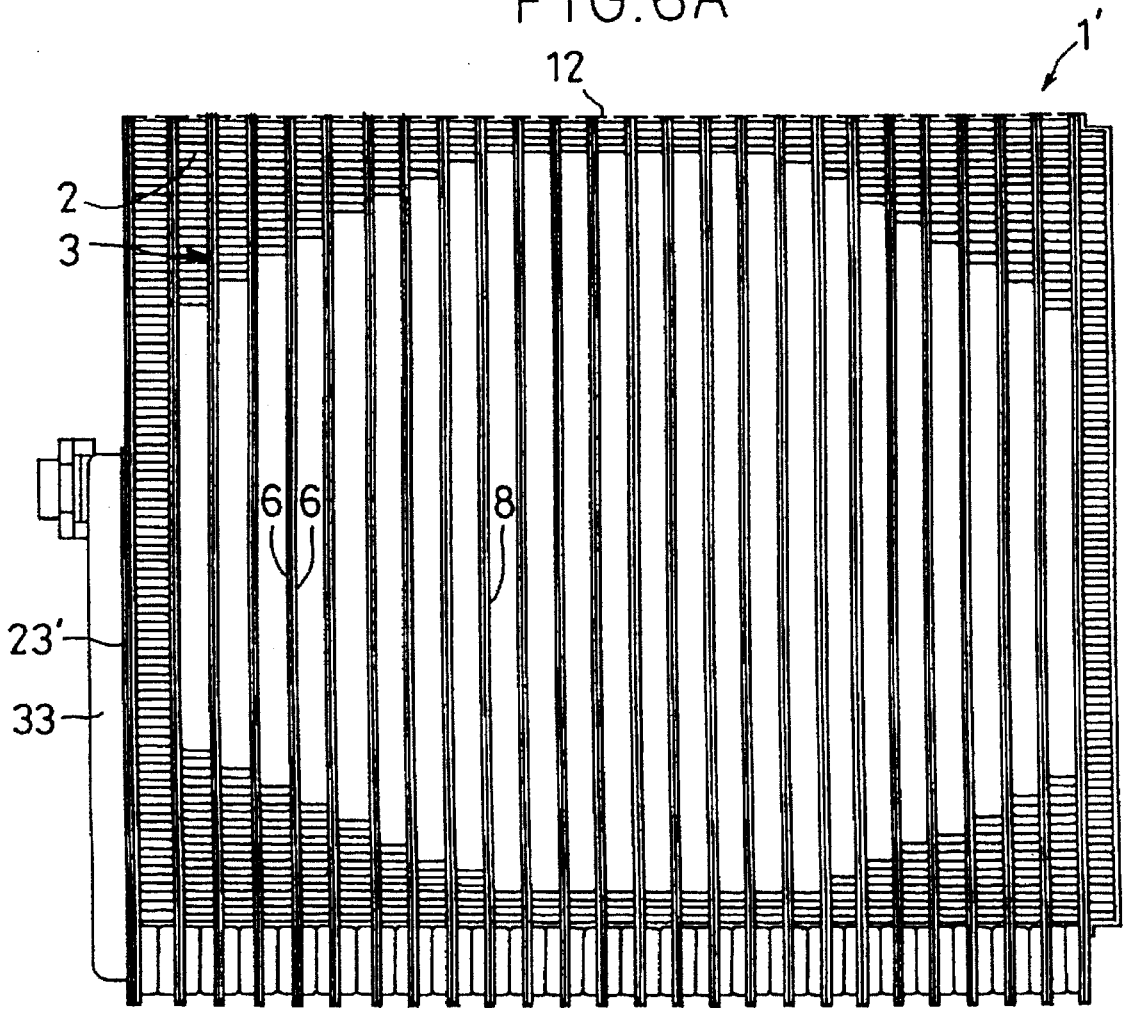
FIGS. 6A and 6B illustrate another embodiment of the laminated heat exchanger according to the present invention, with FIG. 6A showing a front view and FIG. 6B showing a bottom view.
Figure 6B:
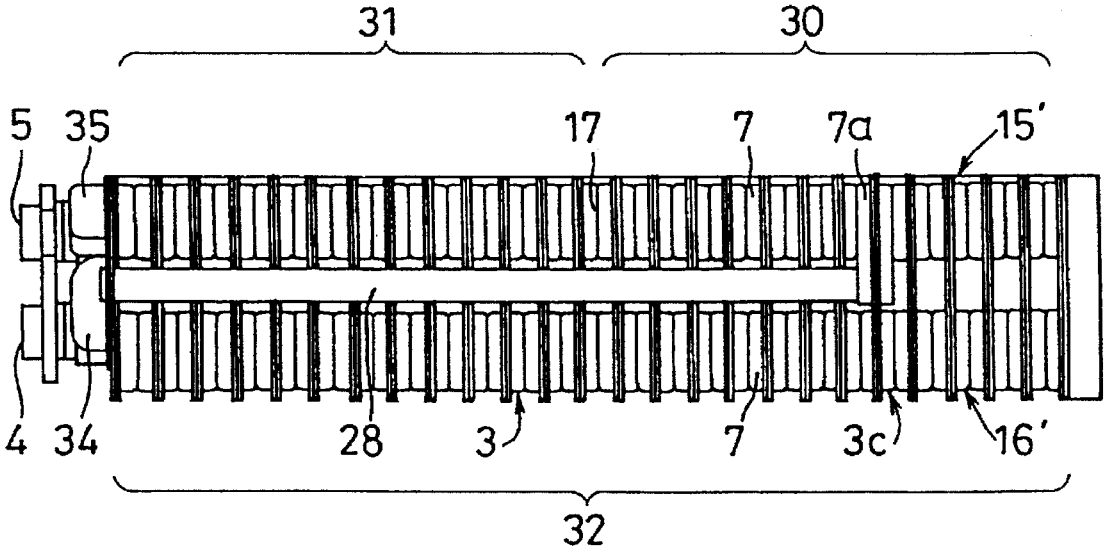

FIG. 6 shows another embodiment of the heat exchanger according to the present invention. This heat exchanger 1' may be, for instance, a four-pass type evaporator provided with an intake portion 4 and an outlet portion 5 for heat exchanging medium at one end in the direction of lamination of the tube elements 3. The formed plates 6, one of which is shown in FIG. 2, are used for constituting the tube elements 3 except for at specific locations and each formed plate 6 is provided with an indented portion 29 for mounting a communicating pipe 28 between the distended portions for tank formation 9. As for tube element 3*c* to provided at a specific location, it is formed by bonding formed plates 6*a* and 6*b*, shown in FIG. 7. Neither of these formed plates is provided with an indented portion and one of the tank portions in the tube element 3*c*, i.e., the tank portion 7*a*, is enlarged so as to lie in close proximity to the other tank portion 7.

The formed plate 6*a* and 6*b* constituting the tube element 3*c* are formed symmetrically except for the hole 40, which is to be explained later. In either formed plate, two convex distended portions for tank formation 9*a* and 9*b* are formed at one end with one of them, i.e., the distended portion for tank formation 9*b*, enlarged so as to occupy the area of the indented portion in the formed plate shown in FIG. 2. All other structural features, such as the distended portion 10 for passage formation the distended portions 9 for tank formation, the projection 11 and the projected tab 12 (shown in FIG. 6*a*) are identical to those in the other formed plates.

As a result, when the two formed plates 6*a* and 6*b* are bonded at their edges, their projections 11 are also bonded and a normal tank portion 7 and an enlarged tank portion 7*a* are formed with the distended portions for tank formation that face opposite each other and a U-shaped passage portion 8 connecting the tank portions is formed with the distended portions for passage formation 10 that face opposite each other.

In the heat exchanger, adjacent tube elements 3 and 3*c* are flush at the distended portions for tank formation of the formed plates to form two tank groups, i.e., a first tank group 15' and a second tank group 16' which extend in the direction of lamination (in a direction running at a right angle to the direction of airflow). In one of the tank groups, i.e., the tank group 15' , which includes the enlarged tank portion 7*a*, all the tank portions are in communication via the communicating holes 19 formed in the distended portions 9 for tank formation, except at the partitioning portion 17, located at approximately the center in the direction of lamination, while in the other tank group, i.e., the tank group 16', all the tank portions are in communication via the communicating holes 19 with no partitioning.

Consequently, the first tank group 15' is divided into two areas, i.e., a first communicating area 30, which includes the enlarged tank portion 7*a* and a second communicating area 31 which communicates with the outlet portion 5 by the partitioning portion 17, whereas, the second tank group 16', without partitioning, constitutes a third communicating area 32.

The intake portion 4 and the outlet portion 5 are provided at an end on the side that is away from the enlarged tank portion 7*a* and are constituted with an intake passage 34 and an outlet passage 35 respectively, formed by bonding a plate for intake/outlet passage formation 33 to an end plate 23', extending toward the tank portions from a point about halfway along the end plate 23' in the direction of its length.

The intake passage 34 and an enlarged tank portion 7*a* communicate with each other through a communicating passage constituted with the communicating pipe 28 which is secured in the indented portions 29 and is connected to a communicating hole formed in the end plate 23' and a communicating hole 40 formed in the enlarged distended portion 96 for tank formation of the formed plate 6*b*. The second communicating area 31 and the outlet passage 35 communicate with each other via a communicating hole formed in the end plate 23'.

Figure 7A:
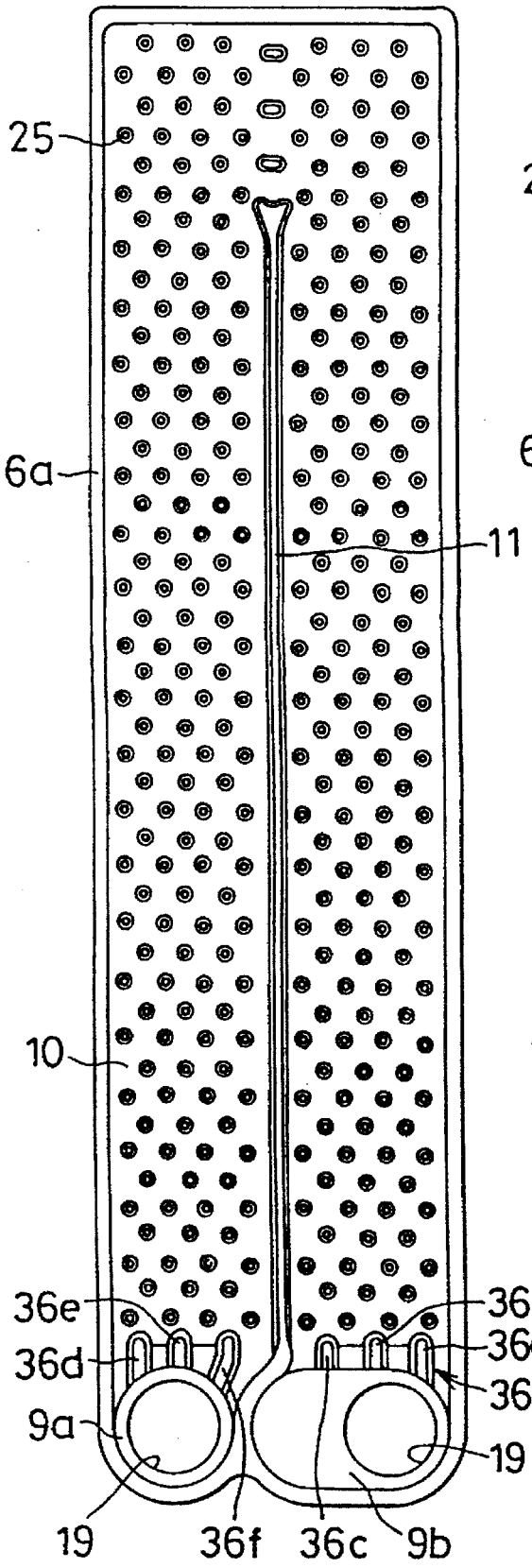
FIG. 7A and 7B show formed plates used for constituting a tube element provided with an enlarged tank portion in the laminated heat exchanger shown in FIG. 6.
Figure 7B:
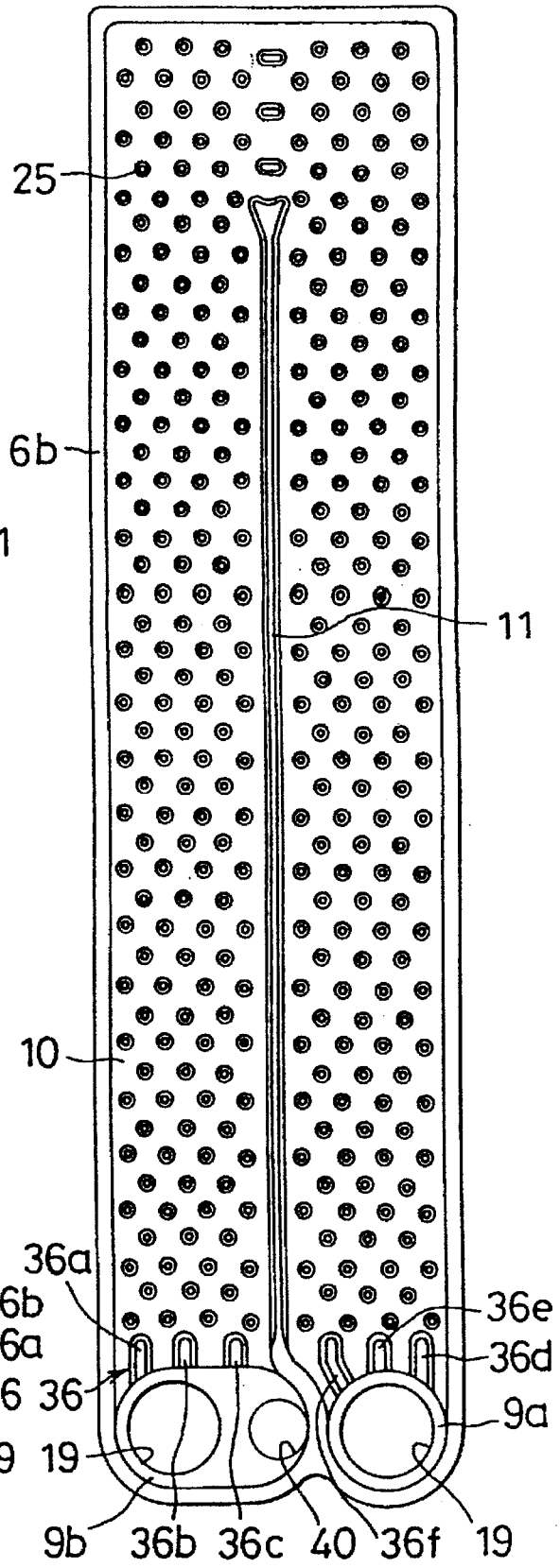
Figure 10:
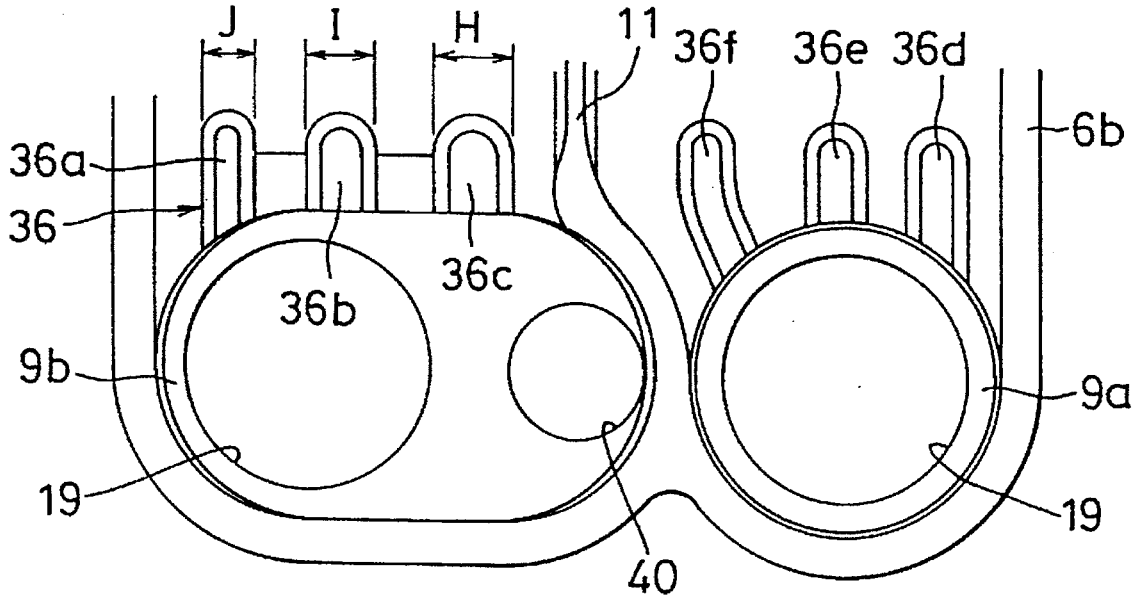
FIG. 10 is an enlarged of a portion of the formed plate shown in FIG. 7B showing the distended portions for tank formation and part of the distended portions for passage formation.

In the tube element 3*c*, provided with the enlarged tank portion 7*a*, a plurality of shoal-like beads 36 (36*a*–36*f*) are formed in the portion 10 of the distended portion for passage formation where the distended portions 9*a*, 9*b* for tank formation change into the distended portion 10 for passage formation, as shown in FIGS. 7 and 10. In this embodiment, three of the plurality of shoal-like beads 36*a*–36*f* are formed in each area where either distended portion for tank formation changes into the distended portion for passage formation and, in particular, on the side where the enlarged tank portion is provided. All of shoal-like beads 36*a*–36*c* are formed linearly in the direction in which the U-shaped passage portion 10 extends.

In addition, among the three shoal-like beads 36a–36c, the shoal-like bead 36c, which is the closest to the communicating hole 40, to which the communicating pipe 28 is connected, is formed wider than the shoal-like beads 36a and 36b that are away from the area where the communicating pipe 28 connects. In other words, when the width of the shoal-like bead 36c is H, the width of the shoal-like bead 36b is I and the width of the shoal-like bead 36a is J, their relationship satisfies H>I and H>J. Specific structural examples that satisfy these requirements include structures that satisfy H>I>J and H>I≈J. In the former relationship it is desirable to set the widths at, for instance, H≈5.3 mm, I≈4.6 mm and J≈3.3 mm and in the latter relationship it is desirable to set them at, for instance, H≈5.3 mm, I=J≈4.6 mm, when factors such as the passage resistance and pressure limit are taken into account.

Note that since the other structural features are identical to those in the embodiment of the laminated heat exchanger according to the present invention described earlier, the same reference numbers are assigned to identical parts and their detailed explanation is omitted.

Figure 8:
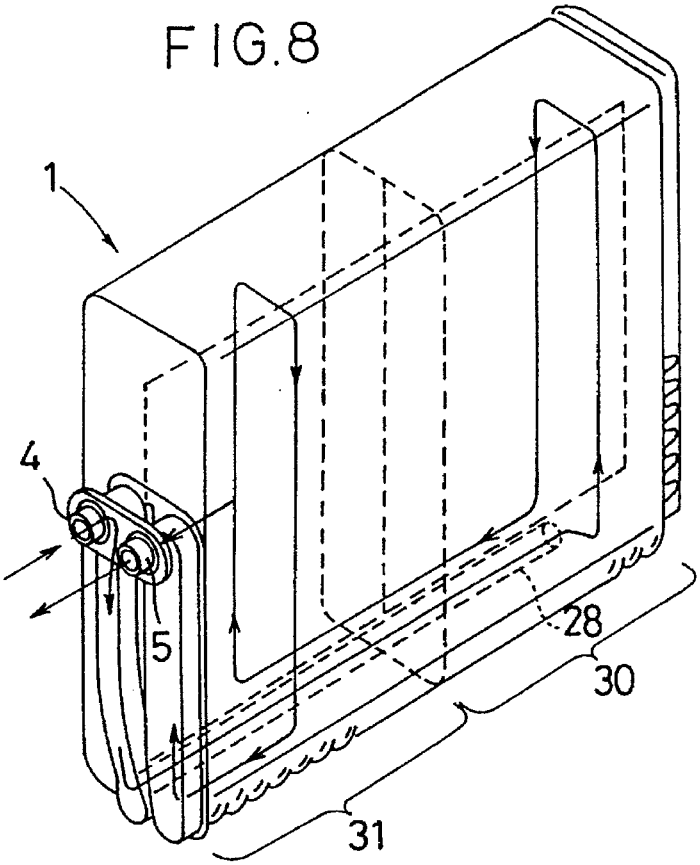
FIG. 8 illustrates the flow of heat exchanging medium in the laminated heat exchanger shown in FIG. 6.

Thus, the heat exchanging medium that has flowed in through the intake portion 4 travels through the communicating pipe 28 to enter the enlarged tank portion 7a . The flow is then is dispersed throughout the first communicating area 30. Then it travels upward through the U-shaped passage portions 8 of the tube elements corresponding to the first communicating area 30 along the projections 11 (first pass). Then it makes a U-turn above the projections 11 before travelling downward (second pass) and reaches the tank group on the opposite side (third communicating area 32). Next, it moves horizontally through the rest of the tube elements 3 which constitute the third communicating area 32, and travels upward through the U-Shaped passage portions 8 of those tube elements, along the projections 11 (third pass). Then, it makes a U-turn above the projections 11 before travelling downward (fourth pass), and is induced to the tank portions that constitute the second communicating area 31. Following this, the heat exchanging medium flows out through the outlet portion 5 (see FIG. 8). This allows the heat in the heat exchanging medium to be communicated to the fins 2 during the process in which the heat exchanging medium flows through the U-shaped passage portions 8 constituting the first through fourth passes, so that heat exchange can be performed by the air passing through the fins.

Figure 9:
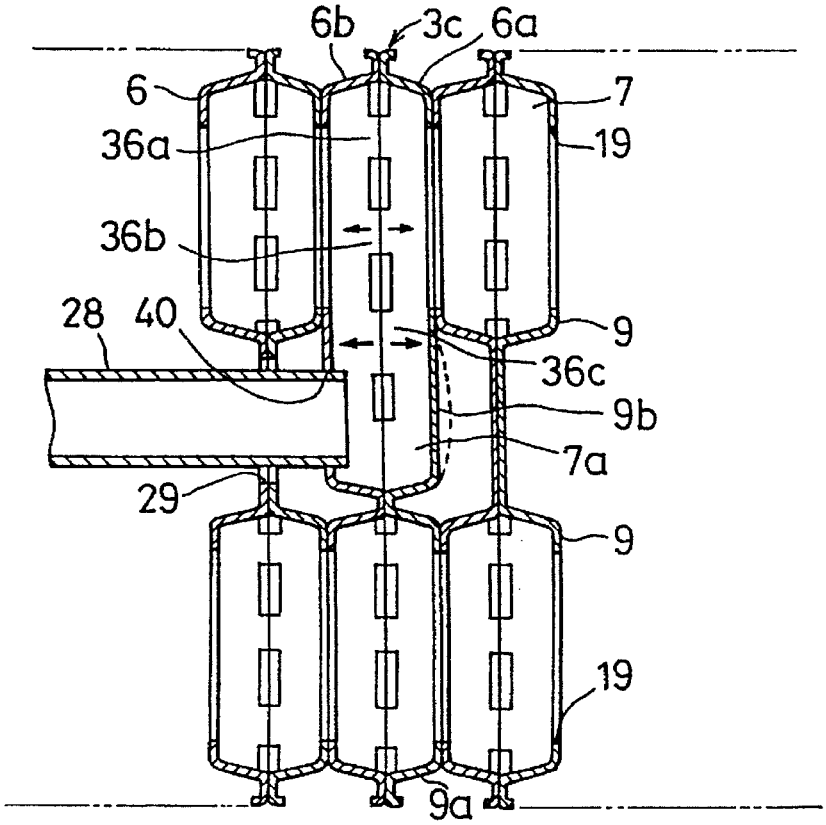
FIG. 9 is a partial, enlarged cross section of the laminated heat exchanger shown in FIG. 6 including the enlarged tank portion with some of the tank portions cut away.

During this process, since, at the portion of the enlarged tank portion 7a which faces opposite the communicating pipe 28, the heat exchanging medium sent from the communicating pipe 28 impacts with the distended portion 96 for tank formation of the formed plate 6a and change direction. Force is imparted in the direction that tends to separate the bonded portions. This force is greater on the shoal-like bead 36c, which is closest to the connecting portion where the communicating pipe is connected, as indicated with the solid-line arrow in FIG. 9. However, since the width of the shoal-like bead 36c near the communicating pipe is formed larger than the widths of the shoal-like beads 36a and 36b located further away from the communicating pipe 28, a secure bonding state is achieved, making rupture less likely to occur even when high pressure fluid is flowing. In the examples with suggested specific numerical values, the strength improves by 1–2% in rupture tests.

Note that while the explanation has been given so far for tube elements employed in an evaporator in reference to the embodiments, it goes without saying that similar advantages are achieved in other types of laminated heat exchangers with a similar structure.

As has been explained, according to the present invention, since, among the shoal-like beads formed in the area of the U-shaped passage portion where the tank portions change into the U-shaped passage portion, the bonding width of the shoal-like beads that are most likely to be ruptured is made relative large thereby ensuring a secure bonding state in that area, and making deformation less likely to occur in that area, as well as in the other shoal-like beads, achieving improvement in overall strength.

What is claimed is:

1. A laminated heat exchanger comprising:

a plurality of tube elements laminated with fins, each of said tube elements including a first tank portion, formed in a first end of said tube element, said first tank portion being provided with communicating holes to permit flow of heat exchanging medium therethrough, a second tank portion, formed in said first end of said tube element, said second tank portion being provided with communicating holes to permit flow of heat exchanging medium therethrough, and a projection extending from a location between said first and second tank portions toward a second end of said tube element to define a U-shaped passageway communicating between said tank portions, wherein in one of said tube elements one of said first and second tank portions is distended in a direction which is perpendicular to the direction of lamination;

a communicating pipe extending adjacent a plurality of said first and second tank portions and being fluidly connected with said distended tank portion; and a plurality of beads in an area between said distended tank portion and said U-shaped passageway, said plurality of beads including an outer bead having a width J, an inner bead positioned closest to said communicating pipe and having a width H, and at least one intermediate bead positioned between said outer bead and said inner bead and having a width I, wherein H, I, and J satisfy the relationship H>I>J.

2. The laminated heat exchanger as claimed in claim 1, wherein the widths of H, I and J are H≈5.3 mm, I≈4.6 mm and J≈3.3 mm.

3. A laminated heat exchanger comprising:

a plurality of tube elements laminated with fins, each of said tube elements including a first tank portion, formed in a first end of said tube element, said first tank portion being provided with communicating holes to permit flow of heat exchanging medium therethrough, a second tank portion, formed in said first end of said tube element, said second tank portion being provided with communicating holes to permit flow of heat exchanging medium therethrough, and a projection extending from a location between said first and second tank portions toward a second end of said tube element to define a U-shaped passageway communicating between said tank portions, wherein, in one of said tube elements, one of said first and second tank portions is distended in a direction which is perpendicular to the direction of lamination;

a communicating pipe extending adjacent a plurality of said first and second tank portions and being fluidly connected with said distended tank portion; and a plurality of beads formed in an area between said distended tank portion and said U-shaped passageway and extending linearly in a direction which is parallel to linear portions of said U-shaped passageway, said plurality of beads including an outer bead having a width J, an inner bead positioned closest to said communicating pipe and having a width H, and at least one intermediate bead positioned between said outer bead and said inner bead and having a width I, wherein H, I, and J satisfy the relationship H>I and H>J.

4. The laminated heat exchanger as claimed in claim 3, wherein H, I, and J satisfy the relationship H>I≈J.

5. The laminated heat exchanger as claimed in claim 4, wherein the widths of H, I and J are H≈5.3 mm, I≈4.6 mm and J≈4.6 mm.

* * * * *